US005787982A

United States Patent [19]

Bakke

[11] Patent Number: 5,787,982

[45] Date of Patent: Aug. 4, 1998

[54] HYDRAULIC DISCONNECTION DEVICE

[75] Inventor: Stig Bakke, Ålgård, Norway

[73] Assignee: Bakke Oil Tools AS, Algard, Norway

[21] Appl. No.: 750,300

[22] PCT Filed: Jun. 1, 1995

[86] PCT No.: PCT/NO95/00089

§ 371 Date: Dec. 5, 1996

§ 102(e) Date: Dec. 5, 1996

[87] PCT Pub. No.: WO95/33912

PCT Pub. Date: Dec. 14, 1995

[30] Foreign Application Priority Data

Jun. 9, 1994 [NO] Norway ..... 942136

[51] Int. Cl.[6] ..... E21B 17/06; E21B 23/04

[52] U.S. Cl. ..... 166/242.6; 166/377; 285/3; 285/315

[58] Field of Search ..... 166/242.6, 242.7, 166/377; 285/3, 308, 315

[56] References Cited

U.S. PATENT DOCUMENTS

| | | | |
|---|---|---|---|
| 2,843,399 | 7/1958 | Arterbury et al. | 285/3 |
| 3,037,797 | 6/1962 | Brown | 166/181 |
| 3,148,894 | 9/1964 | Schwab | 285/3 |
| 3,288,493 | 11/1966 | Brown | 285/3 |
| 3,753,471 | 8/1973 | Kammerer et al. | 175/320 |
| 4,175,778 | 11/1979 | Nunez et al. | 285/3 |
| 4,671,361 | 6/1987 | Bolin | 166/377 |
| 4,760,884 | 8/1988 | Haugen et al. | 166/377 |
| 4,815,540 | 3/1989 | Wallbillich, III | 166/377 |
| 5,219,027 | 6/1993 | Taylor | 166/377 |
| 5,429,192 | 7/1995 | Huber et al. | 166/297 |
| 5,526,888 | 6/1996 | Gazewood | 166/242.6 |

FOREIGN PATENT DOCUMENTS

| | | | |
|---|---|---|---|
| 1328471 | 8/1987 | Russian Federation | 166/377 |
| 1553606 | 10/1979 | United Kingdom . | |
| WO 91/05935 | 5/1991 | WIPO . | |

*Primary Examiner*—Hoang C. Dang
*Attorney, Agent, or Firm*—Head, Johnson & Kachigian

[57] ABSTRACT

A hydraulically or pneumatically releasable disconnecting device (1), through which a liquid can flow, and wherein two end pieces (2, 3) are connected in that an expandable locking ring (20) in normal position engages grooves (23) in a locking sleeve (10). An axially displaceable locking sleeve (6) surrounds the locking ring (20) with one end thereof and prevents the locking ring (20) from expanding and disengage the grooves (23). The locking sleeve (6) is fixed with shear pins (7). When the disconnecting device (1) is to be released, a sealing body (14) is placed in a seat (13) in a piston sleeve (12), preventing flow of liquid therethrough. Hydraulic force acting against the sealing body (14) and the piston sleeve (12), urges the piston sleeve (12) against the safety sleeve (6) such that the shear pins (7) are broken. Thus, the safety sleeve (6) is displaced such that it can no longer surround the locking ring (20). The grooves (23) are provided with inclined flanks, and the axial force against the locking ring (20) gives a resultant radial force causing the locking ring (20) to expand and disengage the grooves (23) in the locking sleeve (10).

4 Claims, 5 Drawing Sheets

HYDRAULIC DISCONNECTION DEVICE

This invention relates to a hydraulically releasable disconnecting device, particularly for use together with equipment carried down into an oil or gas well.

When operating in an oil or gas well, there exists a need for carrying various tools etc. down into the well. The tool is attached to the end of a coil pipe which, in addition to carry the tool, also gives an opportunity of circulating liquid within the well.

It happens that tools get stuck in the well and that it is necessary to convey down special equipment in order to bring it up. Therefore, the coil pipe must be capable of being disconnected from the tool and to be pulled out of the well. In order to have a controlled disconnection, a disconnecting device is placed between tool and coil pipe.

Disconnecting devices have a through-going liquid channel and consist of two main parts releasably coupled together by means of a locking mechanism. When the disconnecting device is released, the two main parts are disconnected.

There are simple disconnecting devices which release upon the occurence of a predetermined traction force, but it is more common to use disconnecting devices which release hydraulically. When releasing hydraulically, a sealing body is first pumped through the coil pipe until it lands in a valve seat in the disconnecting device. The sealing body blocks the liquid flow through the disconnecting device, and continued pumping gives a hydraulic pressure increase and a force releasing the locking mechanism.

In known disconnecting devices, springy finger-like catchers having external enter hooks on the one main part are adapted to be conducted into a hole having an internal catching groove in the other main part. When the enter hooks which are disposed along the periphery of a cylinder, are conducted into the hole, the enter hooks on the catchers mesh with the catching groove. Then, a safety sleeve is guided in between the catchers and prevents these from springing back; then, the enter hooks can not leave the catching groove. The safety sleeve is attached by means of shear pins, and the two main parts of the disconnecting device are locked to each other. The safety sleeve has a passage for liquid and is provided with a seat adapted to receive a sealing body. When the sealing body, normally a steel ball, is carried in and rests against the seat in the safety sleeve, the passage for liquid is closed. When the liquid pressure increases, an axially directed force acts on the sealing body and the safety sleeve. Upon the occurence of a predetermined force, the shear pins are broken, and the safety sleeve is displaced such that it no longer prevents the catchers from leaving the catching groove. Then, the two main parts of the disconnecting device may be separated from each other.

The finger-like catchers are subjected to breakage. A reason to this is the use of rotational and striking tools which give vibrations and fatigue. Bending forces lead to that one of the catchers or a few of them transfer all forces between the two main parts of the disconnecting device, some of the catchers, thus, being overloaded. When an acidizing of a well is carried out, acid is pumped through the disconnecting device. The catchers exhibit a large surface and are, thus, subjected to acid attack. The catchers are corroded, the cross-section thereof being reduced. In order to increase the strength of the catchers and the resistance to acid thereof, the dimensions of the catchers have been increased, and various types of material have been tried out. The result is disconnecting devices having vigorous and relatively rigid catchers requiring a large force to mount and release the locking mechanism. Even with said improvements the catchers are subjected to breakage. Also, disconnecting devices have been made where said catchers are shielded from the liquid flow, but a disadvantage of such shielding is that the area of the through-going channel of the disconnecting device is reduced.

An object of the invention is to provide a disconnecting device having great strength and, thus, high safety. Also, it is an object that the disconnecting device should be simple to mount, and that little or no force is required to open the disconnecting device after the securing means has been neutralized. Further, it is an object that the locking mechanism should be shielded against aggressive liquid such as corrosive and abrasive (containing solid matter particles) liquids, flowing through or past the disconnecting device. It is also an object to secure the shear pins from falling out, and that they are shielded against attacks from aggressive liquids flowing through or past the disconnecting device.

The objects are achieved by means of features as defined in the following claims.

An embodiment of the invention is described in the following with reference to the attached drawings, wherein.

Figure 1:
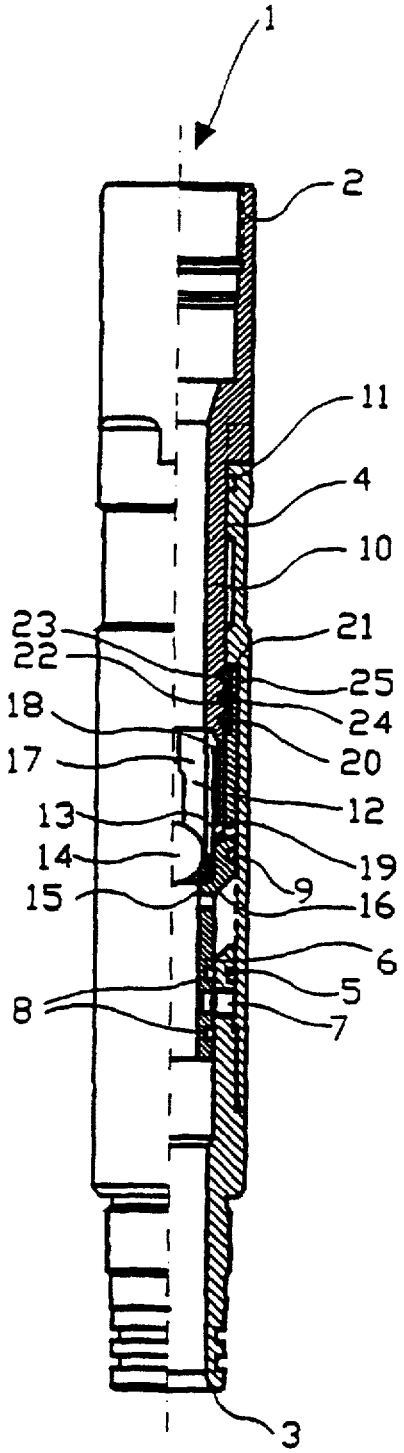
FIG. 1 shows a side elevational view, partly in section, of a disconnecting device wherein a ball-shaped sealing body is placed in a seat, so that the disconnecting device is ready to be released.

In FIG. 1, reference numeral 1 denotes a substantially tubular disconnecting device having a first end piece 2 and a second end piece 3. As known, the end pieces 2, 3 are provided with respectively internal and external connection threads, packer faces and grooves for packers. The disconnecting device is, as known, adapted to be jointed into a pipe string.

Between the end pieces 2, 3, a tubular housing 4 has been disposed, the latter being screwed together with the end piece 3, the housing 4 and the end piece 3 being provided with corresponding threaded portions. Between the end piece 3 and the housing 4, a packing 5 has been disposed. A safety sleeve 6 is arranged axially displaceable in the housing 4 and in the end piece 3, the safety sleeve 6 having a gradation adapted to slide in the bore of the end piece 3. The safety sleeve 6 is axially fixed to the end piece 3 by means of one or more shear pins 7. Advantageously, the shear pins 7 may be provided with a portion having external threads adapted to be screwed into threaded radial holes in the end piece 3. Between the end piece 3 and the locking sleeve 6, packings 8 are disposed, preventing leakage through shear pins 7, and a packing 9 is adapted to seal between the safety sleeve 6 and the housing 4.

A locking sleeve 10 constitutes an extension of first end piece 2 and is adapted to be carried into the housing and further into the safety sleeve 6. A packing 11 seals between the locking sleeve 10 and the housing 4. In the end of the locking sleeve 6, an axially displaceable piston sleeve 12 has been disposed, the latter having an internal seat 13 adapted to receive a sealing body 14. The end face 15 of the piston sleeve 12 is further adapted to seal against an internal seat 16 in the safety sleeve 6. When the locking sleeve 10 is mounted in the housing 4 and the safety sleeve 6, the piston sleeve 12 is pushed into the locking sleeve 10. The piston sleeve 12 is provided with finger-shaped catchers 17 having an external enter hook 18 adapted to engage an internal annular edge 19 in the end of the locking sleeve 10. In order to mount the piston sleeve 12 into the locking sleeve 10 or out of the same, the catchers 17 must be moved radially. The catchers 17 prevent that the piston sleeve 12 falls out of the locking sleeve 10.

A locking ring 20 mounted in the annulus between the locking sleeve 10 and the safety sleeve 6, rests against an internal annular edge 21 in the housing 4. The locking ring 20 is provided with internal ridges 22 engaging into corresponding external grooves 23 in the locking sleeve 10. First end piece 20 is divided into segments kept together by means of a resilient ring 24 running in a groove 25 in the outer face of the locking ring 20. Thus, the locking ring 20 may expand radially to a larger diameter, simultaneously as clearances arise between the segments. The locking ridges 22 and the grooves 23 are provided with inclined flanks. When the locking ring 20 is subjected to an axial force, the locking ring will expand such that the ridges disengage the grooves 23. The resilient ring 24 prevents the segments from falling apart.

In the following, it is described how the disconnecting device 1 is mounted before it is taken into use. First, the piston sleeve 12 is mounted into the locking sleeve 10 as well as the packings 5, 8, 9 and 11. The locking ring 20 is assembled, and the resilient ring 24 is mounted into the groove 25. The locking sleeve 10 is carried into the housing 4 until the end piece 2 is resting against the end of the housing 4. From the other end of the housing 4, the locking ring 20 is threaded in onto the locking sleeve 10, the locking ring 20 expanding such that it can pass externally of the locking sleeve 10. The locking ring 20 is carried in to rest against the internal edge 21 in the housing 4, and the ridges 22 of the locking ring 20 engage the grooves 23 in the locking sleeve 10. The graduated end of the safety sleeve 6 is carried into the end piece 3 and is attached thereto with the shear pins 7 before the end piece 3 is screwed into the housing 4. The safety sleeve 6 is, thus, brought to surround the locking ring 20 such that it can not expand. Thus, axial forces can be transferred from the disconnecting device's one end piece 2 to the other end piece 3 through the locking ring 20.

Disconnection occurs in that the safety sleeve 6 is displaced in the direction toward the end piece 3, so that the locking sleeve 10 no longer surrounds the locking ring 20 which, thus, may expand and disengage the locking sleeve 10. However, the safety sleeve 6 can only be displaced upon the breakage of the shear pins 7.

In the following, it is described how a disconnection is carried out.

Figure 2:
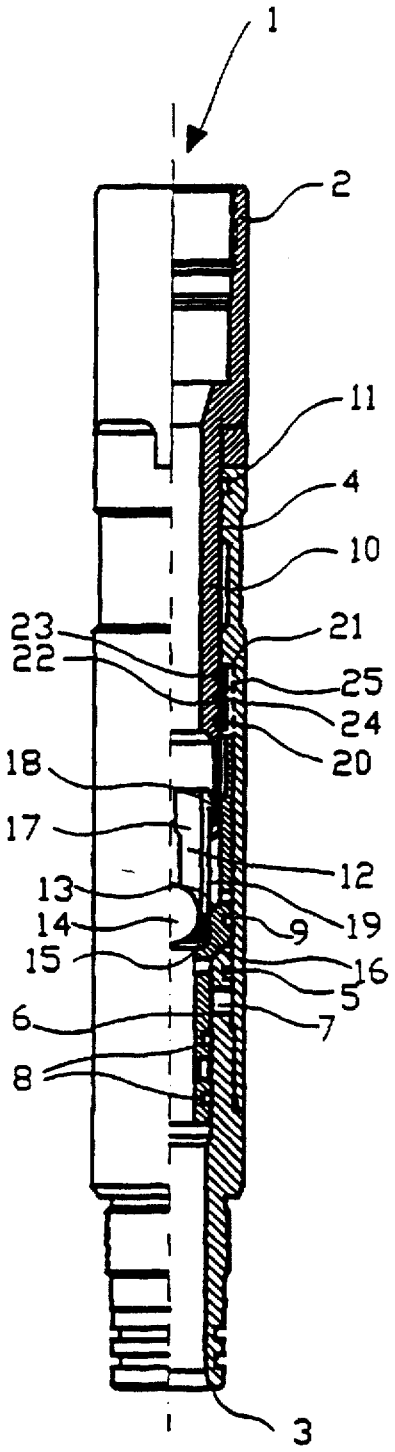
FIG. 2 shows the disconnecting device after the securing means has been neutralized.
Figure 3:
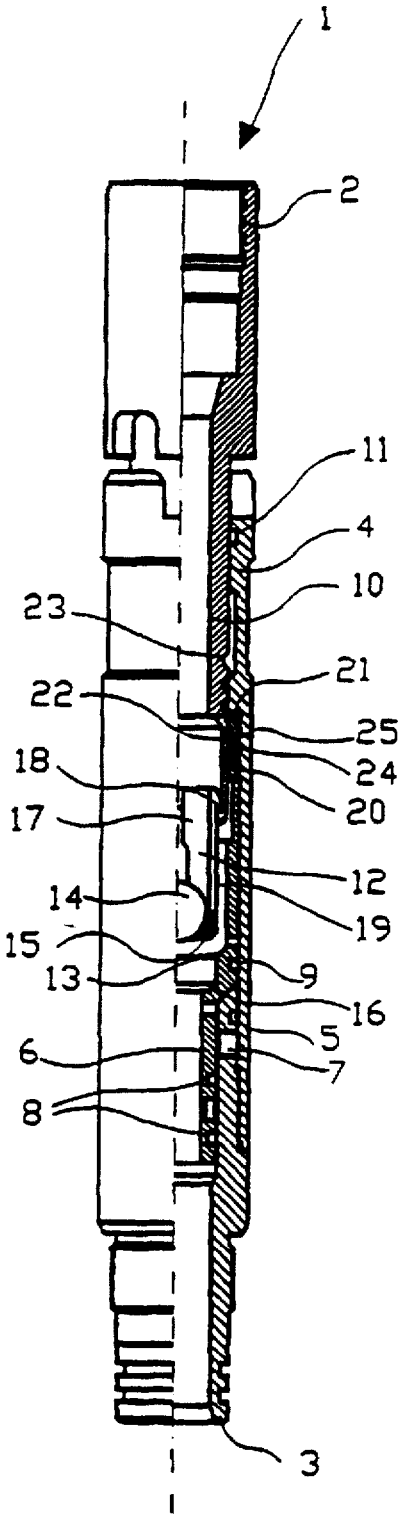
FIG. 3 shows the disconnecting device after release.
Figure 4:
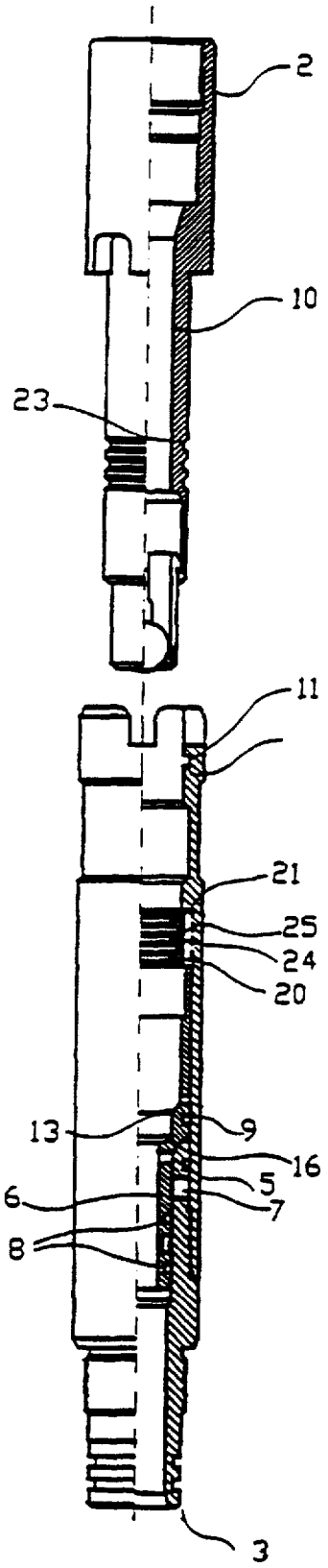
FIG. 4 shows the disconnecting device after the two main parts thereof have been entirely separated from each other.
Figure 6A:
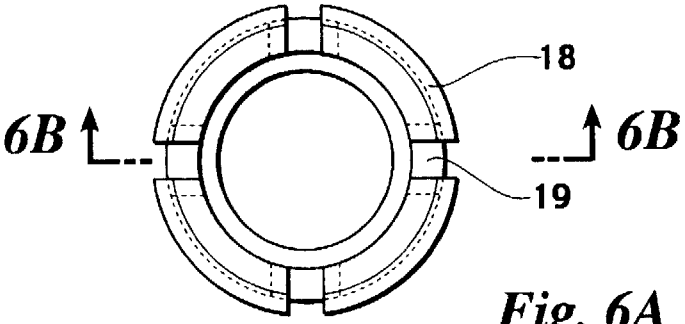
FIG. 6 shows, on the same larger scale, a piston sleeve, seen from above and in section.
Figure 6B:
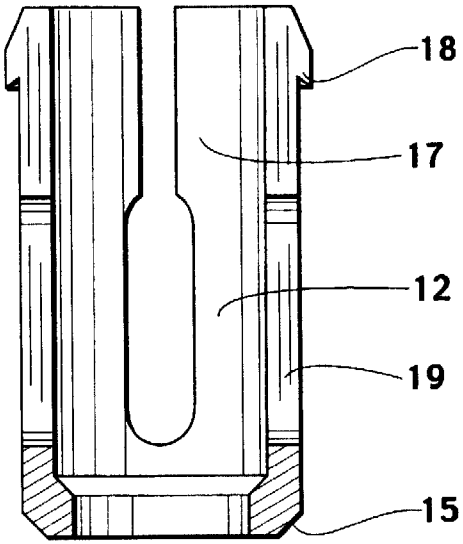
Figure 5A:
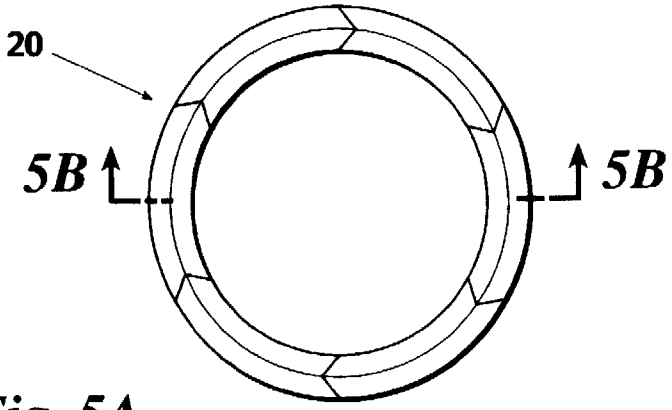
FIG. 5 shows, on a larger scale, a segmented locking ring, seen from the end and in section.
Figure 5B:
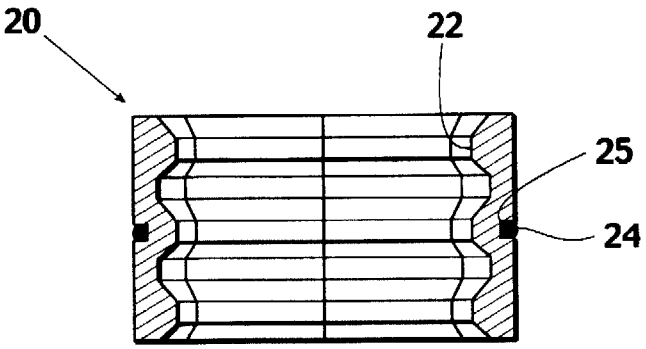

The sealing body 14, normally a steel ball, is brought into the disconnecting device 1 and is pressed tightly against the seat 13 in the piston sleeve 12 by a liquid under pressure, such as shown in FIG. 1. The end face 15 of the piston sleeve 12 is also pressed tightly against the seat 16 in the safety sleeve 6. The safety sleeve 6 is, thus, subjected to an axial force from the piston sleeve 12 and from pressurized liquid which can pass between the catchers 17 of the piston sleeve 12. Through an increase of the liquid pressure, the axial force is increased until the shear pins 7 break, and the safety sleeve 6 is displaced axially until it strikes against the end of the end piece 3, such as shown in FIG. 2. The piston sleeve 12 is displaced in step with the safety sleeve 6 and seals still against the seat 16, the safety sleeve 6 being pressed against the end piece 3, simultaneously as the locking ring 20 accommodates the axial force. The locking ring 20 will expand in the annulus arisen between the locking sleeve 10 and the housing 4 after the displacement of the safety sleeve 6, the end piece 2 with locking sleeve 10, piston sleeve 12 and sealing body 14 being pressed out of the housing 4, such as shown in FIG. 3. In other words, it is not necessary to add an external tensile force in order to release the disconnecting device. After the disconnecting device 1 has been released, the two main parts thereof may easily be separated from each other, such as shown in FIG. 4.

The disconnecting device may also be released pneumatically.

I claim:

1. A hydraulically or pneumatically releasable disconnecting device (1) through which a fluid can flow which comprises:

two end pieces (2,3) releasably locked by at least one shear pin (7);

a locking sleeve (10) extending from said one end piece (2);

a safety sleeve (6) axially displaceable in said other end piece (3);

a sealing body;

release of said lock depending on a preceding breaking of said shear pin (7) and displacement of said safety sleeve, wherein breaking of said shear pin (7) and displacement of said safety sleeve occurs through hydraulic or pneumatic force achieved when said sealing body (14) blocks the flow of liquid therethrough; and a locking ring (20) adapted to expand radially having one or more internal ridges (22) adapted to engage into complementary grooves (23) in the surface of said locking sleeve (10).

2. A disconnecting device as set forth in claim 1 wherein said axially displaceable safety sleeve (6) is adapted to surround the locking ring (20) in order to contain expansion of said locking ring.

3. A releasable disconnecting device as set forth in claim 1 wherein said sealing body is ball-shaped.

4. A hydraulically or pneumatically releasable disconnecting device through which a fluid can flow, which comprises:

a first end piece terminating in an extending locking sleeve;

a second end piece capable of receiving said locking sleeve therein;

a safety sleeve axially displaceable in said second end piece;

a seal body receivable in said safety sleeve;

at least one shear pin retaining said end pieces together said shear pin breakable in response to hydraulic or pneumatic force from said fluid; and a locking ring mounted in an annulus between said locking sleeve and said safety sleeve, said locking ring including a plurality of internal ridges that engage external grooves in said locking sleeve, said locking ring adaptable to expand radially in response to hydraulic or pneumatic force from said fluid.

* * * * *